US007100526B1

(12) United States Patent
Olewicz et al.

(10) Patent No.: US 7,100,526 B1
(45) Date of Patent: Sep. 5, 2006

(54) LABEL/TAG INSERTER SYSTEM

(75) Inventors: Tadeusz Olewicz, Hoschton, GA (US); Preston B. Dasher, Lawrenceville, GA (US); Stephen S. Ruderman, Lilburn, GA (US)

(73) Assignee: Atlanta Attachment Company, Inc., Lawrenceville, GA (US)

( * ) Notice: Subject to any disclaimer, the term of this patent is extended or adjusted under 35 U.S.C. 154(b) by 0 days.

(21) Appl. No.: 11/234,590

(22) Filed: Sep. 23, 2005

Related U.S. Application Data

(60) Provisional application No. 60/613,282, filed on Sep. 27, 2004.

(51) Int. Cl.
*D05B 11/00* (2006.01)
*D05B 35/00* (2006.01)

(52) U.S. Cl. ..... 112/475.08; 112/2.1; 112/470.33; 112/113

(58) Field of Classification Search ..... 112/2.1, 112/152, 153, 470.14, 470.33, 311, 306, 475.02, 112/475.07, 475.08, 104, 113–115; 271/265.01, 271/145; 414/796.5; 53/135.1–135.3
See application file for complete search history.

(56) References Cited

U.S. PATENT DOCUMENTS

| | | | | |
|---|---|---|---|---|
| 3,458,381 | A | 7/1969 | Metcalfe | |
| 4,766,826 | A * | 8/1988 | Block | 112/475.14 |
| 4,986,524 | A * | 1/1991 | Meintzer et al. | 271/100 |
| 5,431,531 | A * | 7/1995 | Nozawa | 414/796.6 |
| 5,479,757 | A * | 1/1996 | Ogawa | 53/135.1 |
| 5,520,129 | A | 5/1996 | Porter et al. | |
| 5,809,919 | A * | 9/1998 | Mitchell et al. | 112/470.07 |
| 5,865,137 | A * | 2/1999 | Frye | 112/470.14 |
| 6,397,768 | B1 * | 6/2002 | Dasher et al. | 112/2.1 |
| 6,662,737 | B1 | 12/2003 | Marcangelo et al. | |
| 6,802,271 | B1 * | 10/2004 | Oxley et al. | 112/2.1 |

* cited by examiner

*Primary Examiner*—Ismael Izaguirre
(74) *Attorney, Agent, or Firm*—Womble Carlyle Sandridge & Rice, PLLC

(57) ABSTRACT

A label inserter system for inserting and sewing a label or law tag into a border for a mattress or foundation during the formation of the border. The label inserter system generally includes a hopper, a label pre-feeder and a label transfer clamp subassembly that engages and moves the label from the hopper and inserts the label between, on top or on the bottom of the cut edges of the border prior to sewing the cut edges to finish the border, with the label being sewn therein.

39 Claims, 12 Drawing Sheets

LABEL/TAG INSERTER SYSTEM

CROSS-REFERENCE TO RELATED APPLICATION

The present patent application is a formalization of a previously filed, co-pending provisional patent application entitled "Label/Tag Inserter System," filed Sep. 27, 2004, as U.S. Patent Application Ser. No. 60/613,282 by the inventors named in this patent application. This patent application claims the benefit of the filing date of the cited provisional patent application according to the statutes and rules governing provisional patent applications, particularly 35 U.S.C. § 119(e)(1) and 37 CFR §§ 1.78(a)(4) and (a)(5). The specification and drawings of the provisional patent application are specifically incorporated herein by reference.

FIELD OF THE INVENTION

The present invention relates to sewing equipment, and in particular, to an automated assembly or system for inserting a label or mattress "law tag" during formation and sewing of a mattress border prior to closing the border to form a finished work piece.

BACKGROUND OF THE INVENTION

In the manufacture of bedding such as mattresses, foundations or box springs, etc., sewing operations for forming and attaching borders, panels and other components traditionally have been extremely labor intensive, manual operations that further generally have required a significant amount of skill on the part of the sewing operator to cut, sew, and finish the bedding components. The more labor intensive and the greater the amount of skill required of the operator to form a component, however, the greater the cost and the more limited or slower the production of such components. As a result, there have been efforts to develop more automated sewing equipment that will enable less skilled operators to operate the equipment and form bedding components, and/or which can be operated with less operator control or intervention required, such that one operator can run multiple sewing stations at one time in order to increase production while decreasing the manpower and skill level of the operator required to form the desired bedding components.

In addition, governmental regulations require that labels or "law tags" be attached to mattresses and foundations or box springs. Such labels or law tags generally provide regulatory and warning information, as well as identify the particular manufacturer of the mattress or foundation. As a result, such law tags or labels are required by law to be sewn into every mattress or foundation during their manufacture. Typically, the insertion and sewing of a law tag or label into a mattress or foundation component has been a substantially manual operation, generally requiring careful placement and sewing of the law tag with a portion of the law tag extending or projecting inside the mattress or foundation. If the tag is removed from the mattress, etc. by the end user, a portion of the tag will remain inside the bed to provide necessary identification information relating to the mattress or foundation to which it is attached.

SUMMARY OF THE INVENTION

In one aspect of the invention, a method is provided for forming a mattress border having a label attached. A length of border material is fed along a path of travel and a measured portion of the material is cut to form the border. Adjacent edges of the border are clamped and moved into a predetermined position in front of a label inserter assembly. The label is automatically lifted from a hopper and inserted between the cut edges of the border. The border is then moved to a closing station and the cut edges are sewn with the label inserted therein to form a completed border.

In another aspect of the invention, an automatic border sewing system is provided for sewing borders for mattresses and foundations with a label inserted therein. A fed and cut assembly receives, measures and cuts a supply of border material to from a border having a desired length. A closer station is located downstream from the feed and cut assembly and has a closer head for sewing cut edges of the border together to from a completed border. A clamp assembly engages the border adjacent its cut ends as the border is cut and transfers the border to the closer station. An automatic inserter assembly includes a hopper for supplying a label, and a label clamp and transfer subassembly having a clamp mechanism that engages the label. An actuator moves the label clamp transfer subassembly forward into a position for inserting the label between the cut edges of the border. A control system monitors and controls operation of the feed and cut assembly, label inserter assembly and closer station to form a completed border with a label sewn therein.

Various objects, features and advantages of the present invention will become apparent to those skilled in the art upon consideration of the following description when taken in conjunction with the accompanying drawings.

BRIEF DESCRIPTION OF THE DRAWINGS

The invention is better understood by reading the following detailed description of the invention in conjunction with the accompanying drawings.

DETAILED DESCRIPTION OF THE INVENTION

Figure 1:
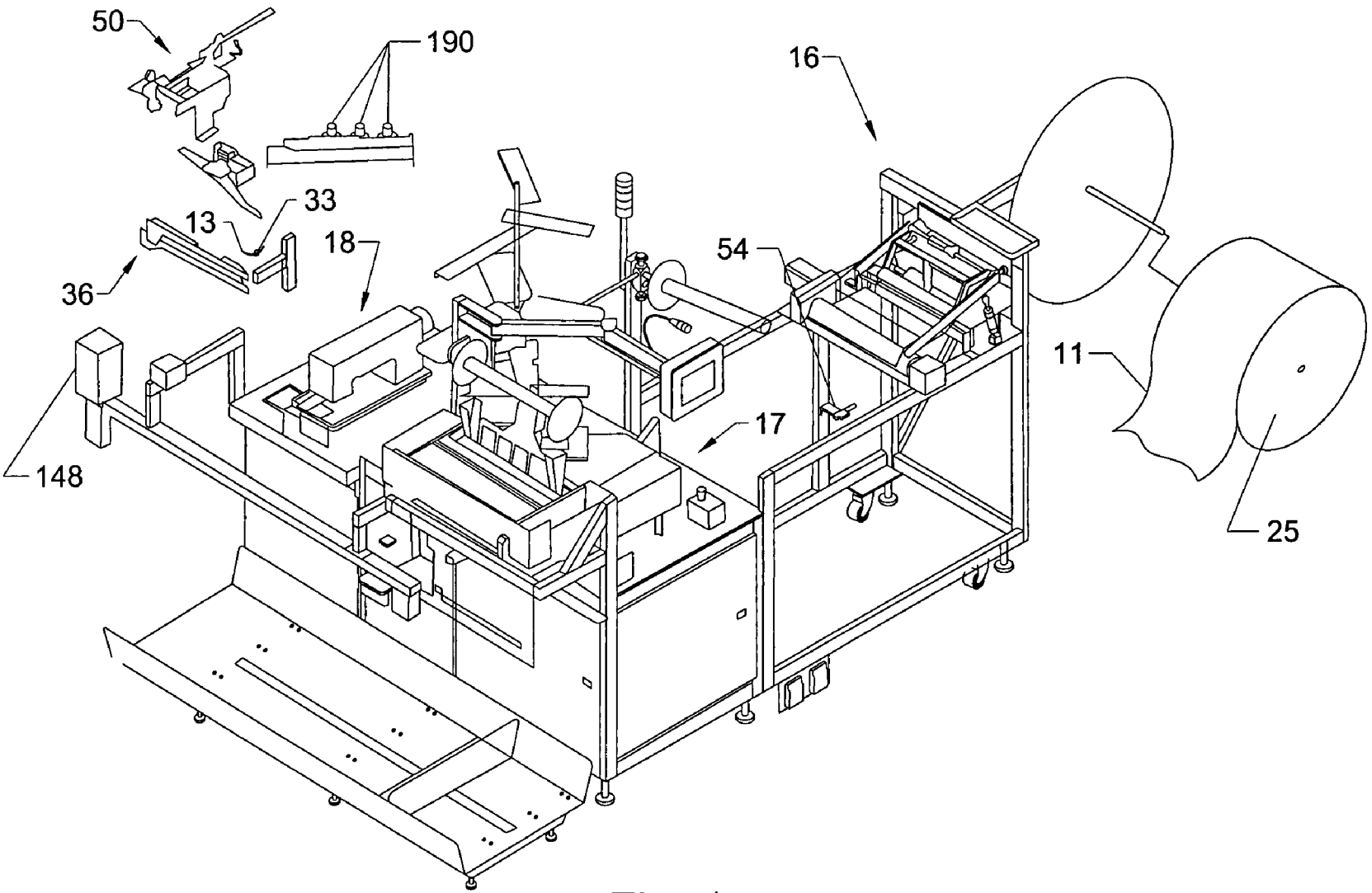
FIG. 1 is a perspective illustration illustrating the label/law tag inserter system of the present invention in use with a border formation and closing station.

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

The present invention generally relates to a system or assembly for inserting a label, such as a law tag, between the ends of a border for a mattress or foundation prior to the closing of the ends of the border so that the label/tag is attached upon the closing of the border with a portion of the tag projecting inwardly. When the border is applied to a frame for a foundation or mattress, a portion of the tag will remain inside the completed mattress or foundation. The label/tag inserter system or assemblies of the present invention generally will be mounted on a border sewing station or system, typically an automatic border sewing system such as an Atlanta Attachment model 3200C, model 3200M, model 3200P, model 3206, model 3261, or model 3300 "Automatic Border Sewing Station." Such an automatic border sewing station typically will be controlled by a programmable control system having an operator interface or input device through which the operator can program different features or styles of mattress borders to be formed and/or different speeds of operation, and which control system will monitor and control the function and operation of the border sewing station with the label/tag inserter system of the present invention.

The automatic border sewing system further generally will include a series of operator assemblies or components including a pre-feed assembly 16 for feeding a length of border material 11 from a supply roll 25, a feed and cut assembly 17, and a closer station 18. For example, such a system is disclosed and claimed in U.S. Pat. No. 6,802,271, the disclosure of which is incorporated herein by reference in its entirety.

As generally illustrated in FIG. 1, the pre-feed assembly 16 of the automatic border sewing station generally will include a feed system including a series of feed rollers that engage and pull a length of border material 11 from an upstream supply roll 25 and feed the border material into the feed and cut assembly 17. The feed and cut assembly 17 will include one or more detectors 54 for controlling the feeding of the border material therethrough, as well as a primary clamp that will engage and hold the border material for feeding. The feed and cut assembly will feed a measured amount of border material therethrough, after which the length of border material will be severed with its cut ends matched to form a border for a desired size mattress or foundation, such as a king, queen, double, etc. The border then will be transferred from the feed and cut assembly 17 to the label/tag inserter assembly 50 of the present invention for insertion of a label/law tag therein.

Figure 2A:
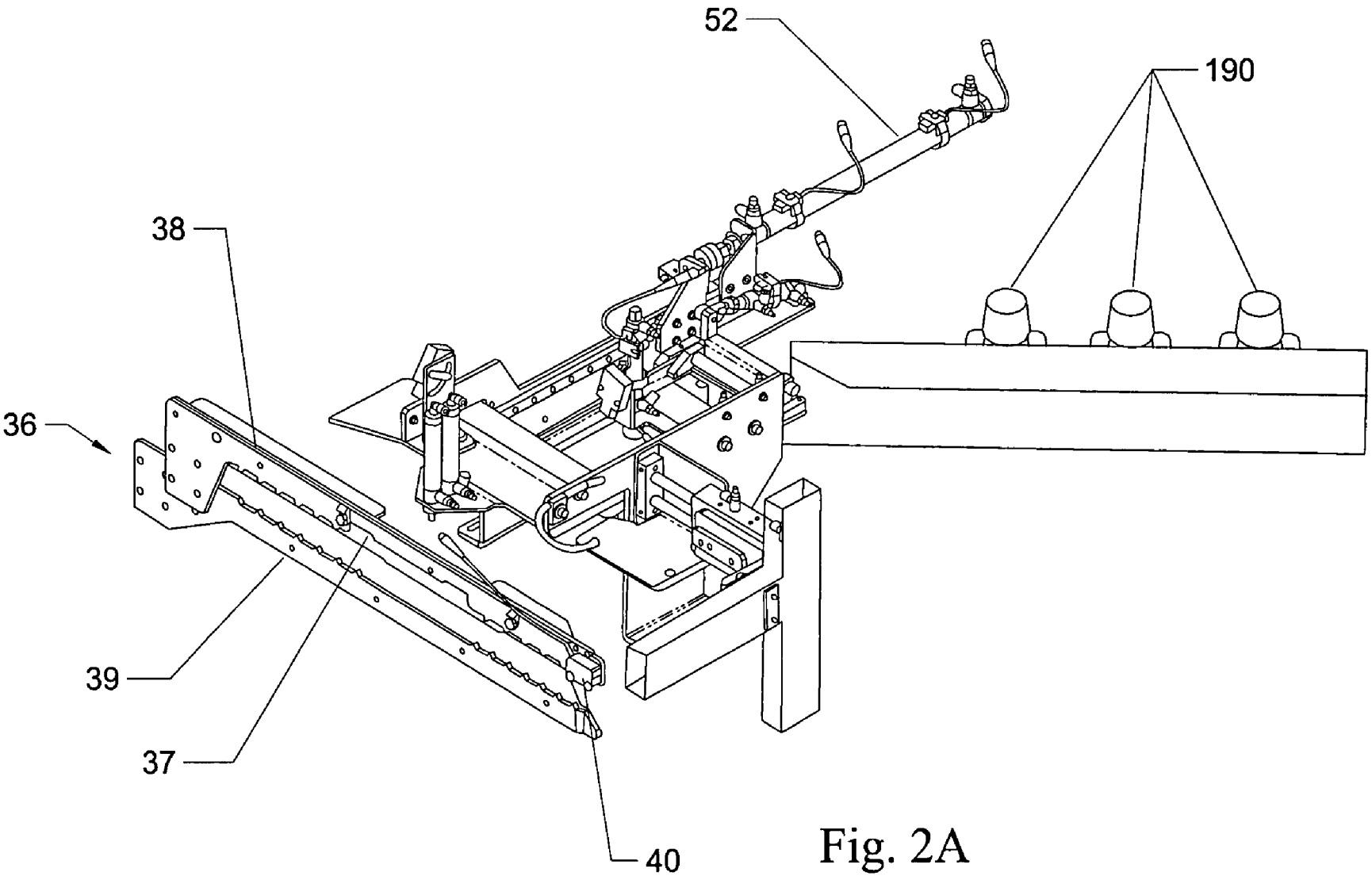
FIG. 2A is a perspective view of the label/law tag inserter system of the present invention.
Figure 2B:
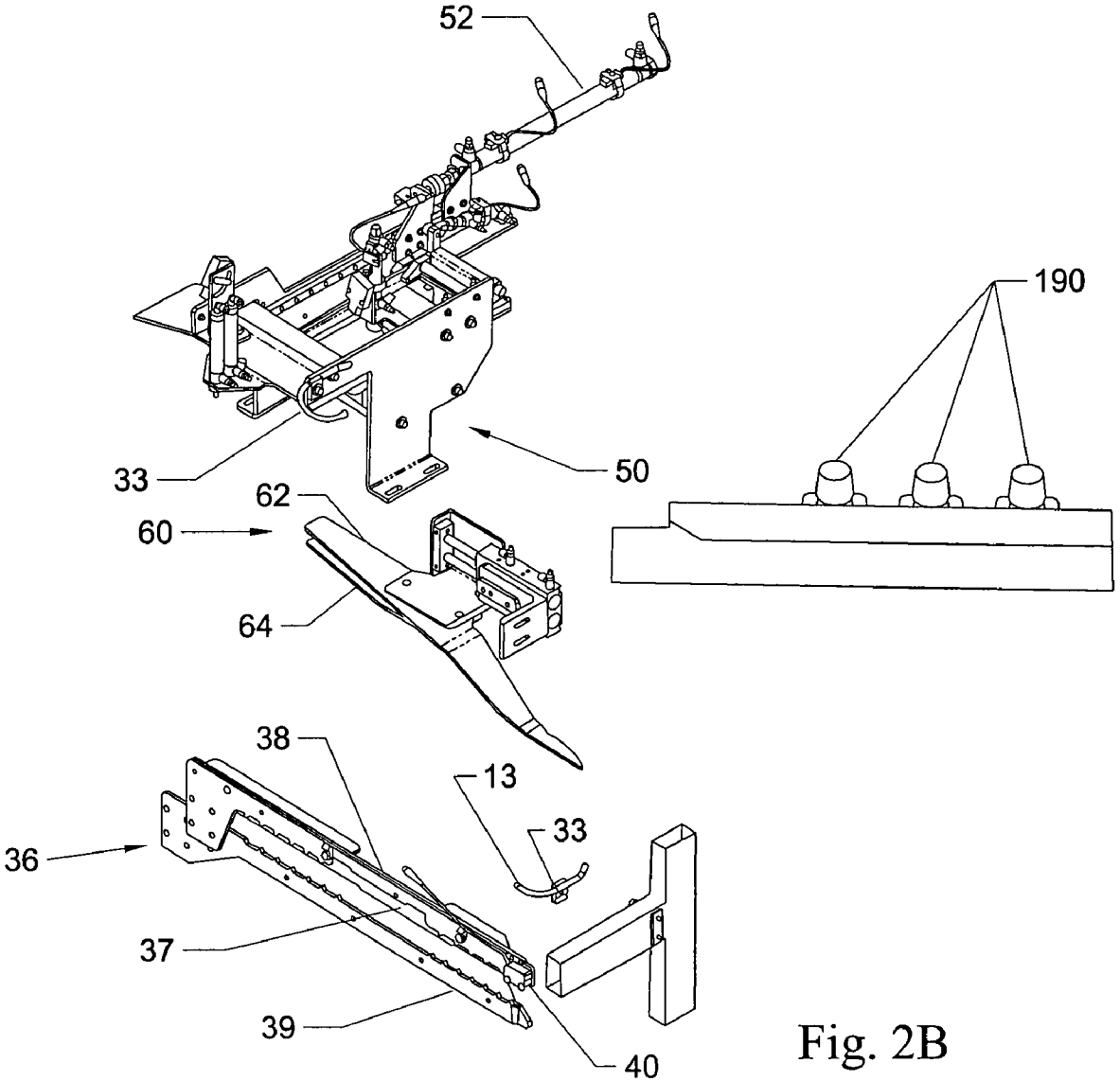
FIG. 2B is an exploded perspective view illustrating the various components of the label/law tag inserter system of the present invention.
Figure 3A:
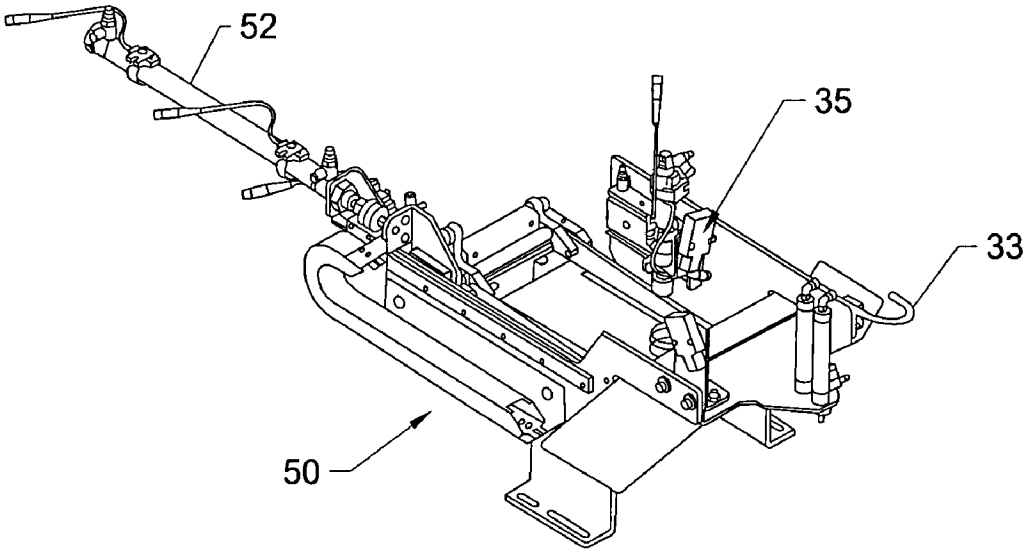
FIGS. 3A–3C are perspective illustrations of the inserter assembly of the label/law tag inserter system of the present invention.
Figure 3B:
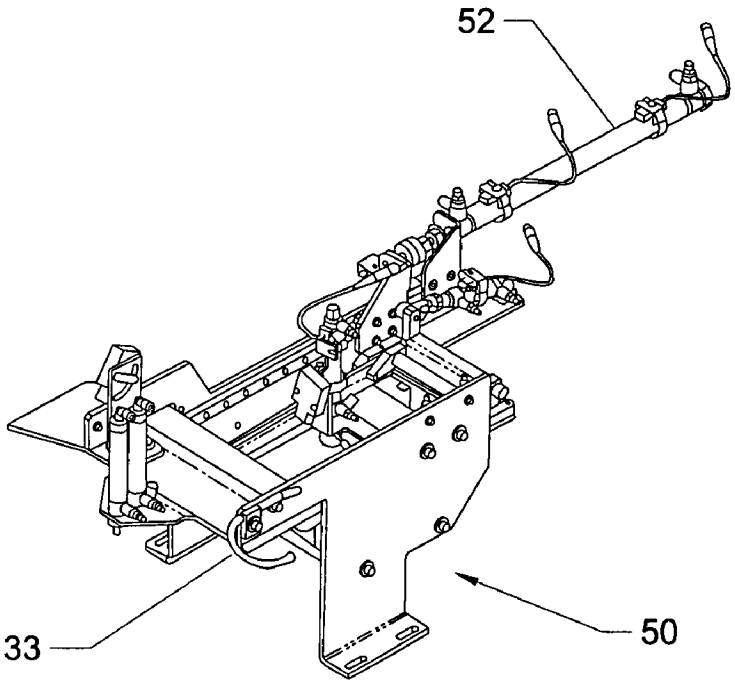
Figure 3C:
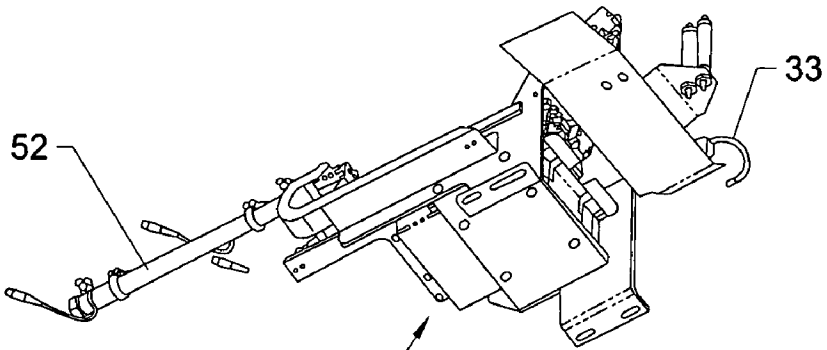
Figure 5:
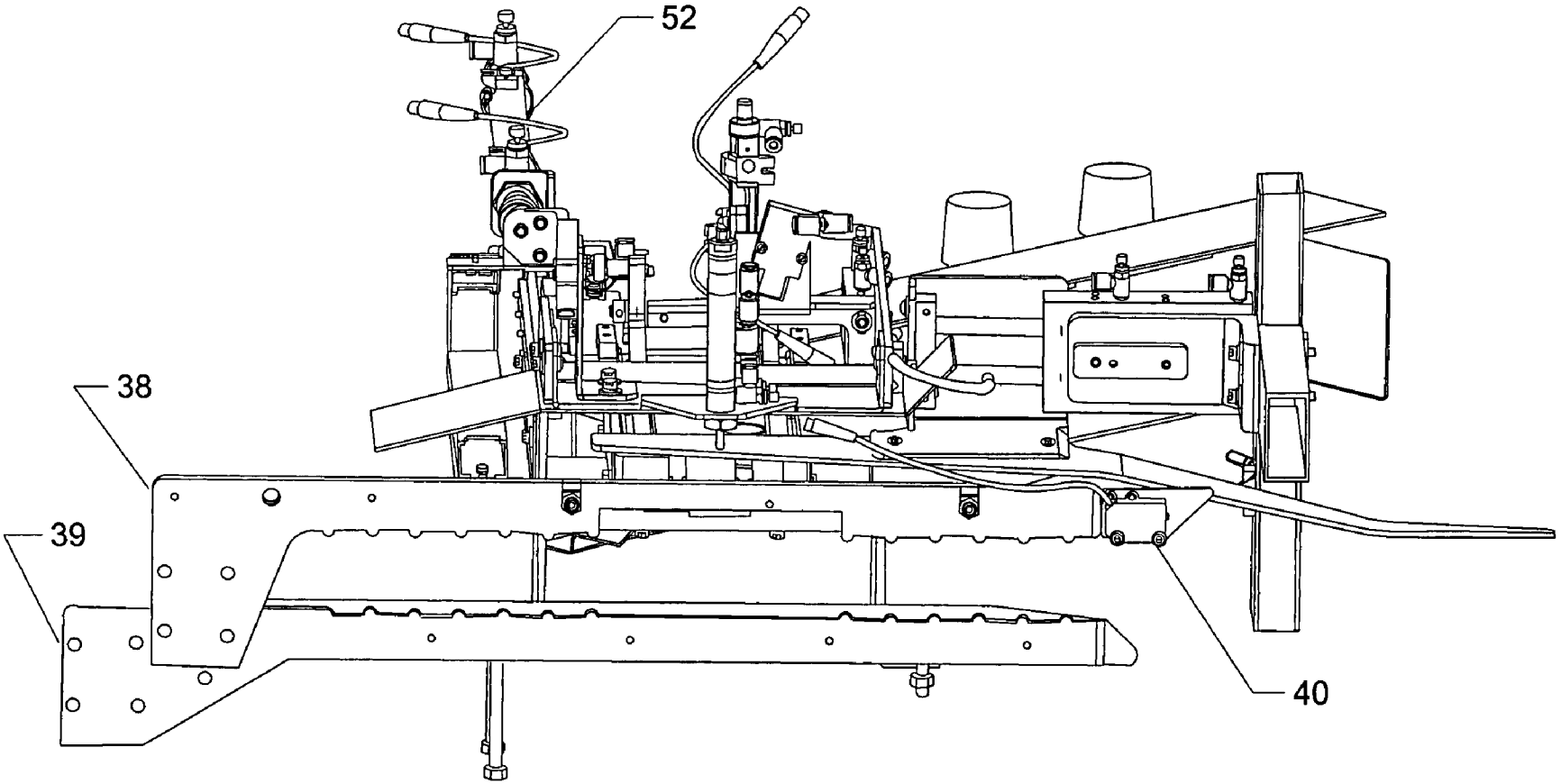
FIG. 5 is a side elevational view generally illustrating the label/tag inserter system of the present invention in a rest position.

After a border 11 of a desired length (i.e., sized to fit a king, queen, etc. sized mattress or foundation) has been fed and cut with its corners mitered and sewn as needed or desired, a secondary clamp mechanism 36 generally is moved into engagement with the border. The secondary clamp mechanism generally includes a first or upper clamp jaw 38 and a second or lower clamp jaw 39. The upper clamp jaw generally is moveable from a separated, non-engaging position into a lowered, clamping position for clamping and holding the border material against the lower clamp jaw 39. As indicated in FIGS. 2A, 2B and 5, the upper clamp jaw 38 generally is formed with a slot or recess 37 formed approximately along a midpoint or section thereof so that a gap or slot is formed between the clamping edges of the upper 38 and lower clamp jaws 39. A sensor 40, such as a photoelectric eye or other similar detector further is mounted on the leading end of the secondary clamp mechanism 36 and detects the leading and trailing edges of the border as the secondary clamp mechanism is moved laterally into a position for engaging and clamping the border. As the sensor detects the leading and trailing edges of the border, it communicates this information to the control system, which accordingly determines the width of the border 11 for positioning the border with the inserter assembly 50 for insertion of a label therein.

The lateral movement of the secondary clamp mechanism 36 is controlled by a motor 148 (FIG. 1) such as a stepper or servo motor, which motor is controlled by the system control for the border sewing station. The motor 148 moves the secondary clamp mechanism 36 from a first or initial insertion position, to a second, clamping position for engaging and clamping the separated border. Thereafter, the secondary clamp mechanism 36 is moved to its insertion position, with the ends of the border 11 clamped therein.

Figure 6A:
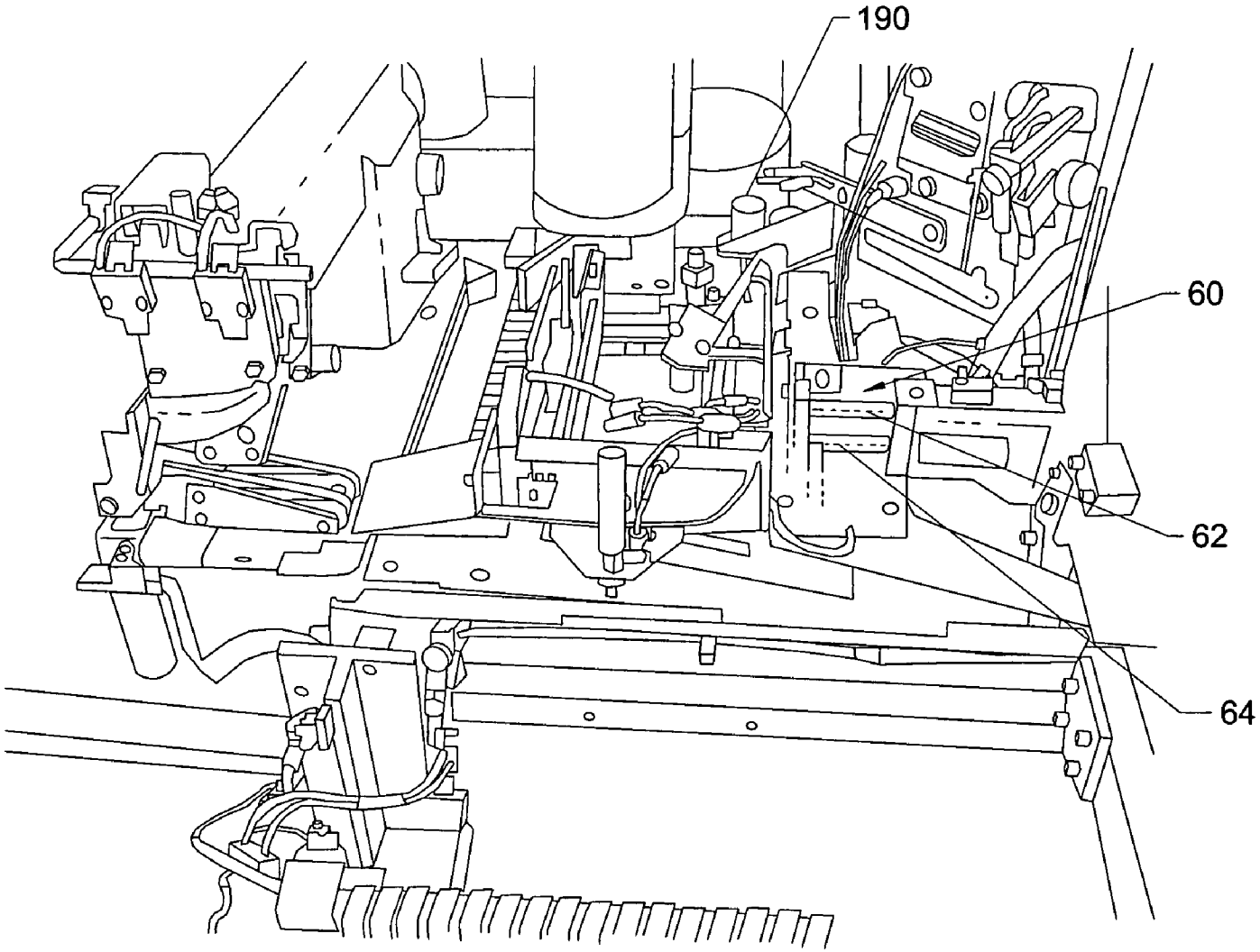
FIGS. 6A–6D are perspective views illustrating several aspects of the label/tag inserter system of the present invention.

In addition, as shown in FIGS. 2B and 6A, a separator 60 is positioned behind the clamp plate and includes a movable upper or first separator plate 62 having an elongated front or forward end that generally slopes downwardly, and a stationary second or lower plate 64 that extends substantially parallel to a rear portion of the moveable separator plate 62 and is spaced slightly vertically therefrom. The moveable separator plate 62 generally is moved laterally toward the border 11 as the border is being measured and cut by the feed and cut assembly 17 of the automatic border station using an actuator 61 such as a pneumatic air cylinder, although other types of actuators such as motors also can be used. The separator plate 60 generally is moved into a position engaging the border material 11 at a desired point before the cutting of the edges of the border material 11 and provides a separation of the cut edges of the border as the border 11 thereafter is engaged and moved to its insertion position by the secondary clamp mechanism 36. The edges of the border material thus are separated as they pass along the upper 62 and lower separator plates 64, with the rearward movement of the secondary clamp mechanism 36.

The secondary clamp mechanism 36 is moved rearwardly until it reaches a calculated insertion position in front of the inserter assembly. The control system (not shown) for the automatic border sewing system generally will be programmed to make a determination as to the size of the border 11 based upon the information received from the sensor 40 attached to the secondary clamp mechanism 36 as to the position of the leading and trailing edges or sides of the border. The control system accordingly will stop the movement of the secondary clamp mechanism 36 in a preprogrammed position in front of the inserter assembly 50.

Figure 6B:
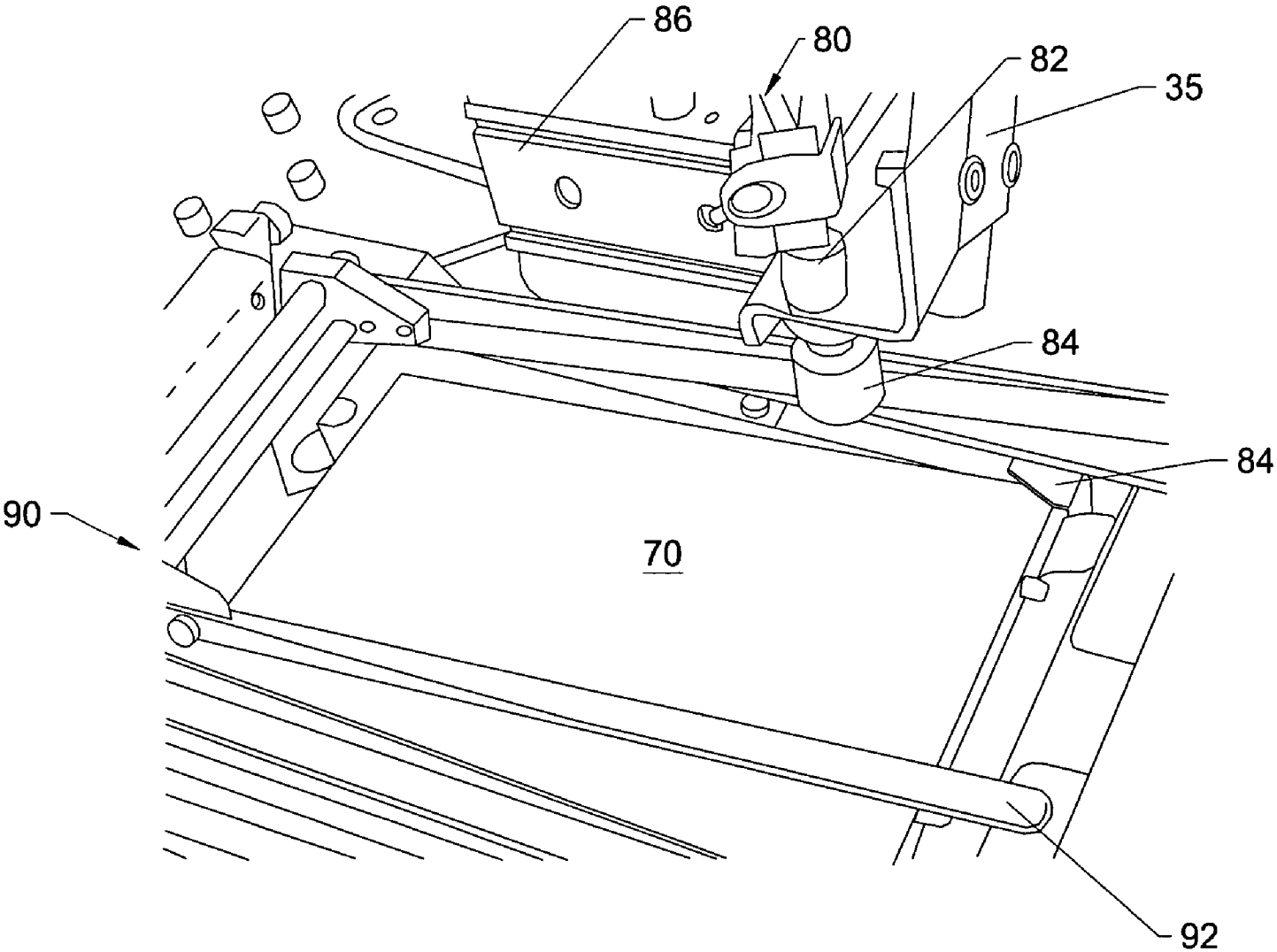
Figure 6C:
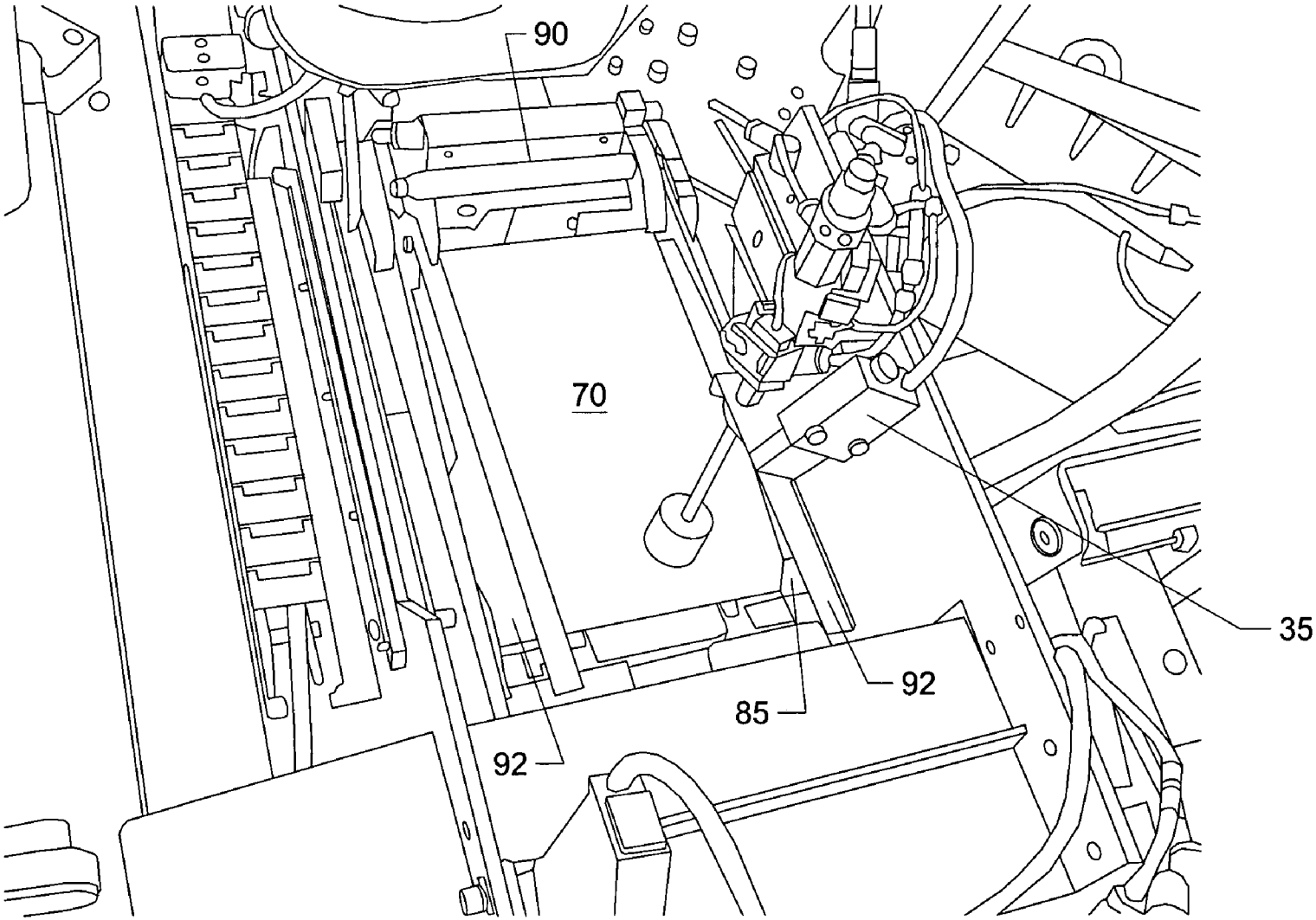
Figure 6D:
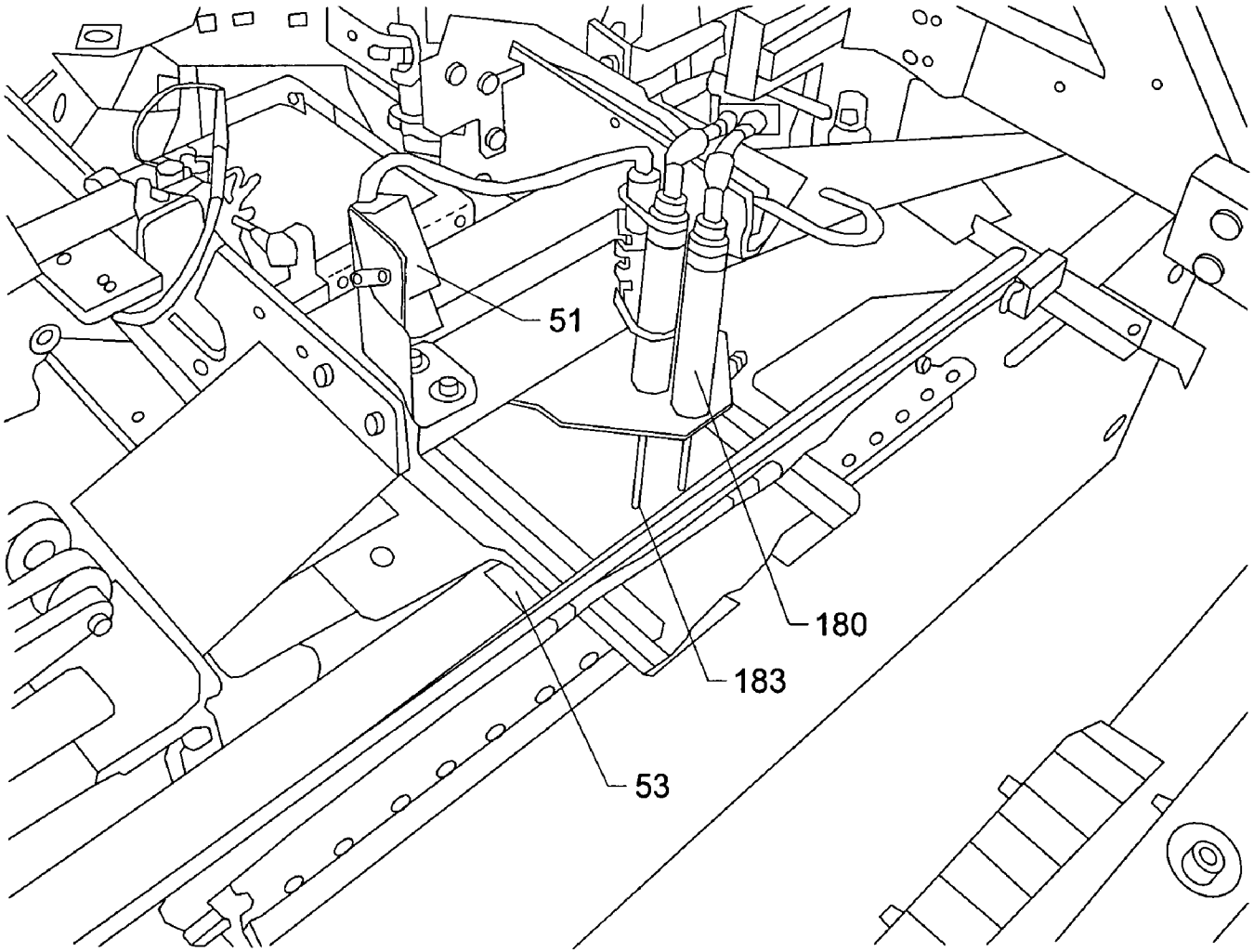

As further illustrated in FIGS. 1–5 and in FIGS. 6C–6D, the inserter assembly 50 has a collision sensor 51, such as a photoelectric eye, proximity sensory or other, mounted in front of the inserter assembly adjacent the upstream edge or side of the inserter assembly. The sensor is positioned to detect the presence or absence of a photoreflective tape 53 applied to an upper edge of the upper clamp arm 38 of the secondary clamp mechanism 36. The photoreflective tape 53 generally is cut to a desired width that is less than the distance between the upstream edge of the cutout or gapped portion 37 of the upper clamp arm 38 and the label clamp arms of the inserter assembly. The purpose of the sensor 51 is to prevent a collision between the label inserter 50, and the secondary clamp mechanism 36. If the sensor 51 fails to detect the presence of the photoreflective tape 53 when the secondary clamp mechanism 36 stops for label insertion, it advises the control system for the automatic border sewing station that there is a fault condition and that the secondary clamp mechanism 36 is not in the correct position for the label insertion. In response, the operation of the system typically will be paused to inform the operator about the error or shut down to prevent damage to the inserter assembly 50 or secondary clamp mechanism 36. If the sensor detects the photoreflective tape 53 when the secondary clamp mechanism 36 stops, the inserter assembly 50 inserts the label between the cut edges of the border material.

In addition, as shown in FIGS. 2A–4, a first blower or air tube 33 (FIGS. 3A–3C) is provided adjacent the inserter assembly for applying a flow of air across the upper cut edges of the border to remove any curl therefrom. Similarly, a lower, second or clamp air tube 13, generally shown in FIG. 2B, will be mounted to a support in a position slightly below the secondary clamp mechanism 36 and separator plates 62, 64 for applying a flow of air to the bottom cut edges of the border for removing curl therefrom and causing the edges to be flattened against the separator plates 62 and 64.

Figure 4:
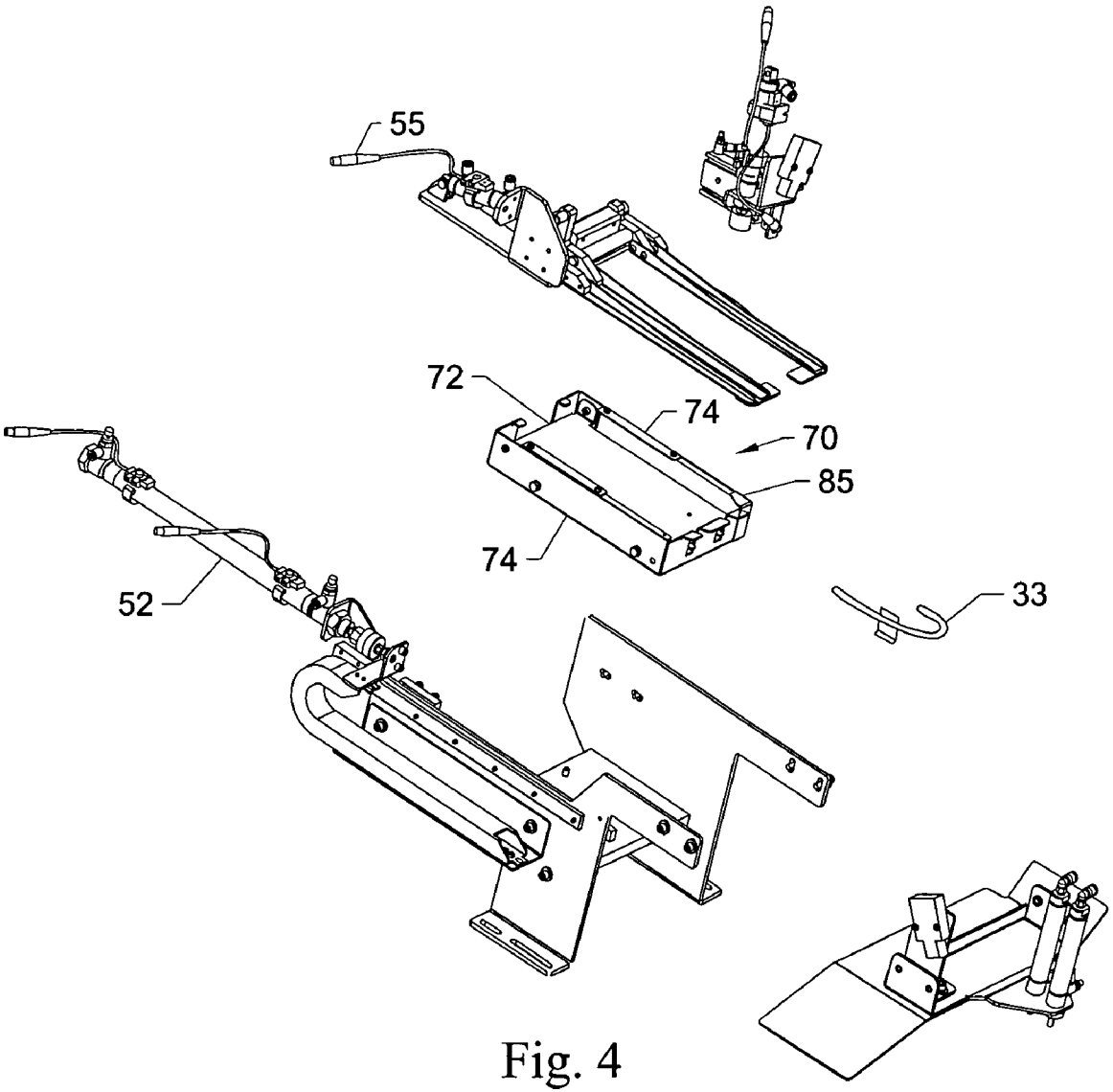
FIG. 4 is an exploded perspective view of the inserter assembly.

The inserter assembly 50 is generally shown in FIG. 1 and is shown in further detail in FIGS. 2B–4. As illustrated, the inserter assembly 50 includes a hopper 70, which generally comprises a bin or tray 72 having a spring biased plate that is urged upwardly, as illustrated in FIG. 4. The tray further includes a pair of side guide portions 74 that project inwardly over the sides of the tray, and a corner hold down tab 85, typically formed by enclosing one of the corner portions at the forward end of the tray. As a result, a stack of labels can be inserted into the tray and will be urged upwardly between the guides and against the corner hold down tab portion 85 by the force of the spring urging the plate upwardly to hold the labels within the hopper.

As shown in FIG. 6B, a label pre-feeder 80 is provided adjacent the forward end of the hopper 70 and includes a hydraulic or pneumatic cylinder 82 or other actuator, actuated by the control system. In addition, the label pre-feeder 80 includes a foot 84 at the end of its cylinder rod, which foot typically is formed from polyurethane or similar tacky surface material, although other types of materials can also be used. The pre-feeder cylinder is mounted on a travel cylinder 86 so as to be moved forwardly with respect to the hopper 70 upon engagement of the uppermost label in the hopper by the foot of the cylinder 84 to move the label into position for insertion into the border. A label detector or sensor 35, such as a photoelectric eye or similar sensor is mounted adjacent the pre-feeder cylinder and travels back and forth with it when cylinder 86 is extended or retracted and detects the presence or absence of a label within the hopper 70, and causes further operation of the label inserter and border sewing station to be halted if no label is present. The label detector further detects whether the label has been moved by the pre-feeder to its position for insertion, as well as detecting the actual insertion of the label by detecting the absence of the label upon movement of the inserter clamp. The label detector communicates with the control system to control operation of the engagement and movement of the topmost label out of the hopper into a position for insertion between the cut edges of the border during an insertion operation.

The inserter assembly further includes a label transfer clamp subassembly 90, comprising an inserter clamp having a pair of clamp arms 92 (FIG. 6B) that are moved forwardly along the upper edge of the hopper 70 into a position to engage and clamp a label that has been picked up or fed from the hopper 70 by the pre-feeder 80 and place it between the plies of the border. The clamp arms 92 are pivotable between opened and closed, engaging positions for engaging the label, typically by a clamp cylinder such as a hydraulic or pneumatic cylinder or similar actuator. The inserter clamp further typically includes a clamp detector 55 (FIG. 4) that monitors the internal travel of the cylinder rod of the clamp cylinder to determine if the clamp cylinder has been fully opened or fully closed prior to its forward movement for insertion of a label between the cut edges of the border. The forward and rearward movement of the label transfer clamp subassembly 90 further is controlled by a drive cylinder or similar actuator, which likewise includes a drive cylinder sensor array. The sensor array typically includes two sensors mounted in spaced positions along the length of the drive cylinder the detect the amount of travel of the cylinder rod of the drive cylinder to ensure that the label transfer clamp subassembly 90 has been properly extended and/or retracted before continuing with the next steps in the label insertion operation and a subsequent border closing operation.

Figure 7:
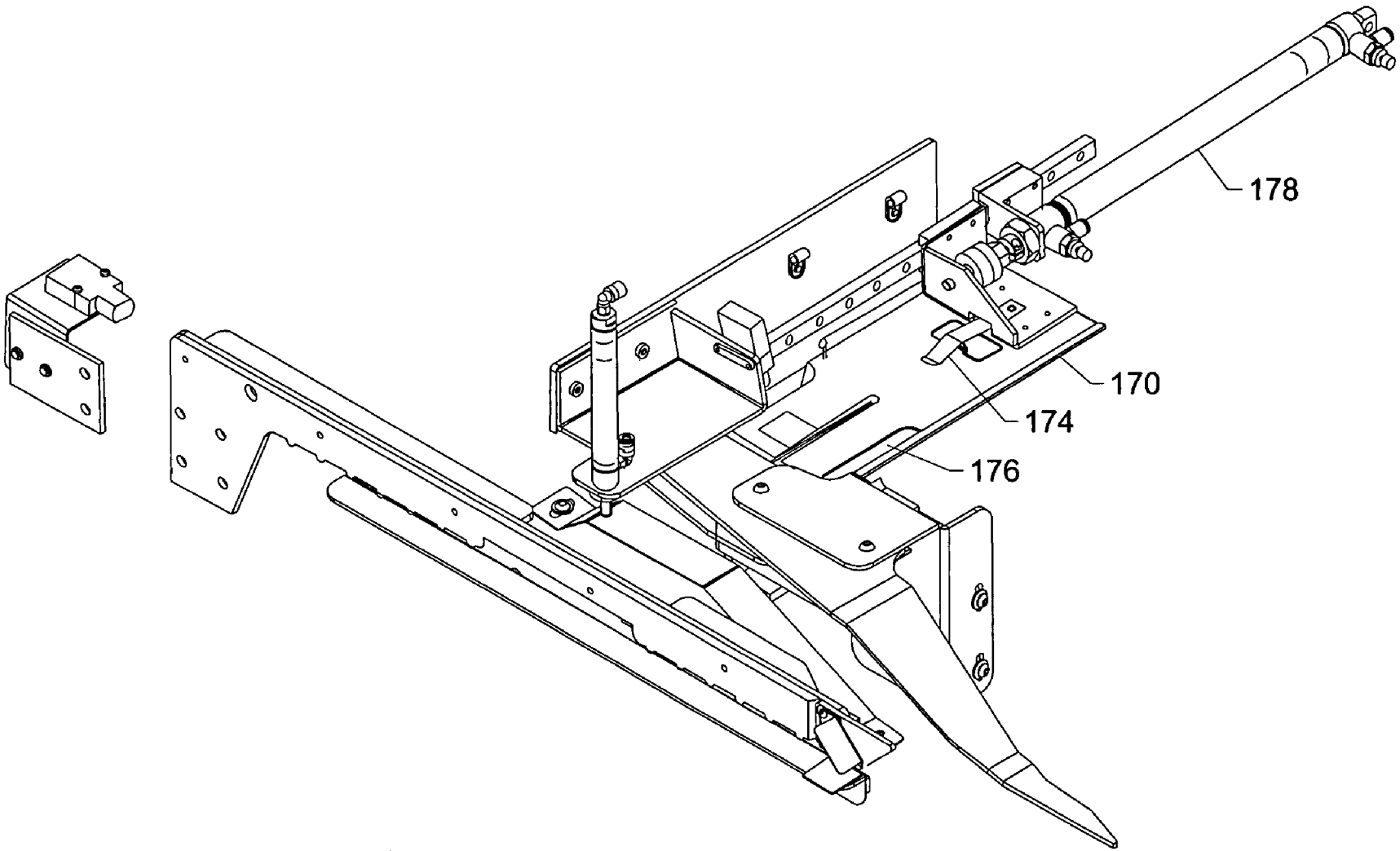
FIG. 7 is a perspective view of an alternative embodiment of the label/tag inserter system.

Additionally, as shown in FIG. 7, in an alternative embodiment of the present invention, a single label or law tag can be inserted into or on top of the top or bottom ply of a border for insertion along the border's seam. In such an embodiment or arrangement, the hopper typically will be replaced with a label holder plate 170 that is moveable from a retracted, loading position, to a forwardly extending insertion position. The label holder includes a clamp 174 or similar holding mechanism that will hold the label in place during an insertion operation and will move the label along a guide plate 170 that typically includes a pair of side guides 176. The label typically will be urged forwardly, off the forward or front edge of the guide plate 170 by the extension of the drive cylinder 178 of the label holder so as to insert the end of the label between the cut edges or plies of the border. In this embodiment, each of the labels typically will be individually or manually placed within the clamp by an operator for insertion between the cut edges of a border.

After the label has been inserted, a pair of label hold cylinders 180 as shown in FIG. 6D, are positioned in front of the label inserter assembly 50. When the cylinders 180 are activated, their cylinder rods 183 will be extended into engagement with the border. This causes the label inserted between the edges/plies of the border to be clamped and held between the plies of border as the label transfer subassembly releases the label and is returned to its rest or starting position. In addition, each of the cylinders for the label transfer clamp subassembly 90, the label pre-feeder 80 and the label hold cylinders 180 are all generally controlled by a regulator 190 which is illustrated in FIG. 6A. The regulator 190 generally includes a plenum through which a fluid medium, such as air, is passed and fed through the drive cylinder for the label transfer clamp subassembly 90, label pre-feeder 80 and the label hold cylinders 180, and further includes adjustable controls such as dials or knobs for adjusting the amount of pressure being applied to each of these respective cylinders.

For example, the drive cylinder for the label transfer clamp subassembly can be set at approximately 20–25 psi, while the cylinder 82 of the label pre-feeder 80 can be set at approximately 10 psi, and the label hold cylinders 180 at approximately 10–15 psi. It will also be understood by those skilled in the art that various greater or lesser pressures also can be used, with the pressures typically being set at a safe level to avoid damage to the label inserter assembly 50 when a fault condition exists. Thus, if the secondary clamp mechanism 36 transporting the border fails to fully transport the border to its insertion position centered in front of the label inserter assembly 50, such that the forward movement of the clamp arms 92 of the label transfer clamp subassembly 90 would engage the upper 37 or lower clamp arm 39 of the secondary clamp mechanism 36, the pressure for the drive cylinder for the label transfer clamp subassembly 90 generally is set low enough such that any further forward movement of the label transfer clamp subassembly 90 will be stopped and the pressure urging the label transfer clamp subassembly 90 forwardly against the clamp arm will be insufficient to bend or otherwise damage the label transfer clamp subassembly 90 or the clamp arm of the secondary clamp.

Once the label has been inserted and the label transfer clamp subassembly 90 has been returned to its start position, the clamp and hold cylinders 180 are disengaged so as to release the border material, and the secondary clamp assembly 36 then proceeds to the closing station 18. As the border enters the closing station 18, sensors detect the leading and trailing edges of the border, after which the border can be engaged by a puller that feeds the cut edges of the border through the closer station 18 for sewing and closing the edges to form a completed border having a label or law tag sewn therein.

Figure 8:
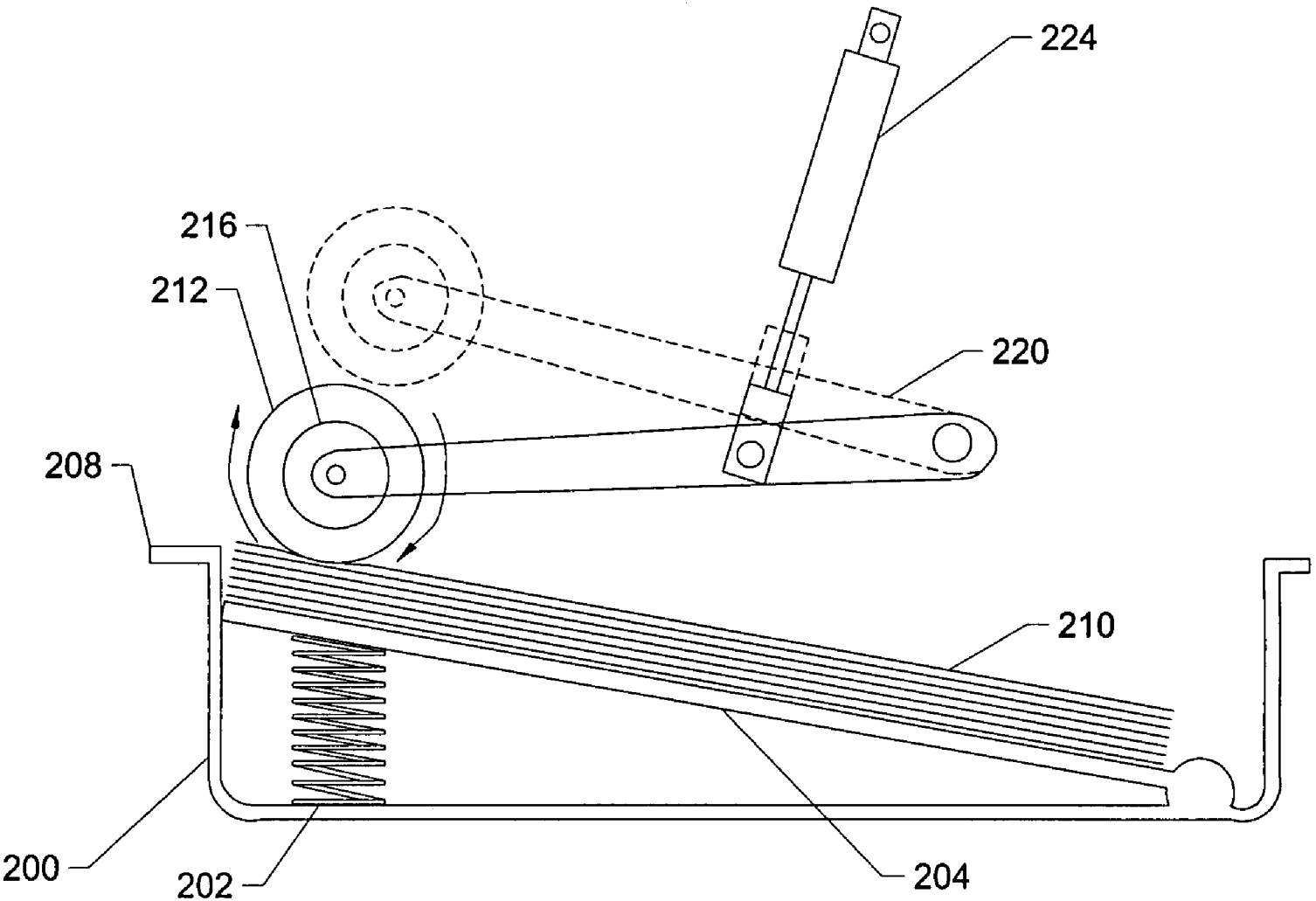
FIG. 8 illustrates a side elevational view of a rotary label feeder mechanism in accordance with an alternate embodiment of the invention.

In an alternate embodiment of the invention, FIG. 8 illustrates a side elevational view of a rotary label feeder mechanism that is used instead of the label pre-feeder mechanism. As discussed above, the label pre-feeder mechanism includes a pneumatic cylinder mounted on a travel cylinder that moves forward with respect to the hopper upon engagement of the uppermost label. The rotary label feeder mechanism includes a high friction index wheel 212 mounted on an indexed rotary cylinder 216. The rotary cylinder is mounted on a pivot arm 220. The pivot arm is attached to a pivot cylinder 224 to facilitate moving the index wheel and cylinder from an engaged position in which the index wheel 212 is in contact with the uppermost label to an up position in which the index wheel and cylinder are disengaged from the labels 210 in the hopper 200. The index wheel and cylinder are raised in order to fill the hopper with additional labels for feeding into border material.

An advantage of the rotary label feeder mechanism is that the index wheel does not move with the label. There is an angular relationship between the index wheel 212 and the label support plate 204 inside label hopper 200. The label support plate 204 is fixed in position on one end. Near the other end of the label support plate 204, a torsion or other suitable spring 202 attaches the support plate 204 to the bottom inside surface of hopper 202. The support plate 204 loaded with labels 210 is close to horizontal when the hopper 200 is full. As the labels 210 are fed from the hopper 200, the angle of the support plate 204 changes. The contact point between the index wheel 212 and uppermost label does not change as labels 210 are fed. The index wheel 212 propels the label forward, with subsequent labels moving at a slightly changing angle as each label is fed into the border material.

As the index wheel 212 rotates (e.g., 80–90 degrees), depending on the circumference of the wheel, the top label is fed a certain distance. For example, to prefeed a label one inch using a wheel that has a one inch diameter would require that the wheel rotate 120 degrees. Adjustable, automatic indexed rotary cylinders 216 suitable for use in this embodiment are readily available in the market. The index cylinder 216 can be a pneumatic or electrical device (solenoid actuated), or could be motor or belt driven.

Pivot cylinder 224 is attached on one end to the framework of the border sewing machine assembly. It is attached to the pivot arm 220 on the other end at a distance of about one third to one half the distance from the fixed end of the pivot arm so that a short cylinder stroke can be used. Pivot arm 220 is attached on its fixed end to the framework of the border sewing machine assembly. The pivot cylinder 224 is connected to the pivot arm 220 at an angle with respect to the vertical. When the index wheel 212 and index cylinder 216 are in the up (disengaged) position, the pivot cylinder 224 is nearly perpendicular to the pivot arm 220. This enables smooth mechanical movement of the index wheel and cylinder. Other orientations of the pivot cylinder with respect to the pivot arm are also possible.

It will be understood by those skilled in the art that while the invention has been discussed above with reference to preferred embodiments, various changes, modifications and additions can be made thereto without departing from the spirit and scope of the invention as set forth in the following claims.

What is claimed is:

1. A method of forming a mattress border having a label attached, comprising:

feeding a desired length of a border material along a path of travel;

cutting a measured portion of the border material sufficient to form a border of a desired size;

clamping the border adjacent cut edges thereof and moving the border into a predetermined position in front of a label inserter assembly;

automatically engaging and inserting a label between the cut edges of the border; and moving the border into a closing station and sewing the cut edges of the border with a label inserted therein to form the completed border.

2. The method of forming a mattress border having a label attached of claim 1 further comprising detecting a leading and a trailing edge of the border before clamping the adjacent cut edges of the border.

3. The method of forming a mattress border having a label attached of claim 1 further comprising separating the cut edges of the border in order to insert the label.

4. The method of forming a mattress border having a label attached of claim 1 further comprising applying an airflow across the upper and lower cut edges of the border to remove curl and to flatten the cut edges.

5. The method of forming a mattress border having a label attached of claim 1 further comprising determining if the cut edges of the border are in the predetermined position for insertion of the label.

6. The method of forming a mattress border having a label attached of claim 5 further comprising sending a fault condition indication to an operator monitor if the cut edges of the border are not in the predetermined position.

7. The method of forming a mattress border having a label attached of claim 1 wherein the step of automatically engaging and inserting a label comprises engaging an uppermost label in a hopper including a plurality of labels and moving the label into a position for insertion between the cut edges of the border.

8. The method of forming a mattress border having a label attached of claim 7 further comprising the step of determining if at least one label is present in the hopper.

9. The method of forming a mattress border having a label attached of claim 8 further comprising the step of communicating with a control system to control engagement and movement of the uppermost label out of the hopper and into position for insertion between the cut edges of the border.

10. An automatic border sewing system for sewing borders for mattresses and foundations with a label inserted therein, comprising:

a feed and cut assembly that receives, measures and cuts a supply of border material to form the border having a desired length;

a closer station downstream from the feed and cut assembly having a closer head for sewing cut edges of the border together to form the completed border;

a clamp assembly for engaging the border adjacent its cut ends as the border is cut by the fed and cut assembly and transferring the border from the feed and cut assembly to the closer station;

a separator positioned behind the clamp assembly, the separator including a moveable upper plate having an elongated front end that generally slopes downward, and a stationary lower plate extending substantially parallel to a rear portion of the upper plate and spaced slightly apart from the upper plate in a vertical direction;

an automatic inserter assembly including a hopper for supplying at least one label and a label clamp and transfer subassembly having a clamp mechanism for engaging the label and an actuator for moving the label clamp transfer subassembly forwardly into a position for inserting the label in between the cut edges of the border; and a control system for monitoring and controlling the operation of the feed and cut assembly, label inserter assembly, and closer station to form a completed border with a label sewn therein.

11. The automatic border sewing system of claim 10 wherein the feed and cut assembly comprises a detector for controlling the feeding of border material through the feed and cut assembly.

12. The automatic border sewing system of claim 10 wherein the feed and cut assembly further comprises a primary clamp that engages and holds the border material for feeding.

13. The automatic border sewing system of claim 10 wherein the clamp assembly comprises a pair of clamp jaws with an upper clamp jaw moveable from a separated, non-engaging position into a lowered, engaged clamping position for clamping and holding the border against a lower clamp jaw.

14. The automatic border sewing system of claim 13 wherein the upper clamp jaw comprises a slot formed along a midpoint of a clamping edge thereof.

15. The automatic border sewing system of claim 14 wherein the slot forms a gap between the clamping edge of the upper clamp jaw and a clamping edge of the lower clamp jaw in the engaged clamping position.

16. The automatic border sewing system of claim 10 further comprising a sensor mounted on a leading edge of the clamp assembly for detecting a leading and a trailing edge of the border as the clamp assembly is move laterally into a position for engaging and clamping the border.

17. The automatic border sewing system of claim 10 further comprising an actuator for moving the separator laterally into a position engaging the border at a point before the edges of the border are cut with the cut edges separated by the separator as the border is moved to an insertion position by the clamp assembly.

18. The automatic border sewing system of claim 17 further comprising a motor for moving the clamp assembly from a clamping position in which the separated cut edges of the border are engaged and clamped to a label insertion position.

19. The automatic border sewing system of claim 16 wherein the control system includes programmable code for determining a size of the border based upon information received from the sensor attached to the clamp assembly.

20. The automatic border sewing system of claim 19 wherein the control system stops movement of the clamp assembly in a preprogrammed position in front of the inserter assembly.

21. The automatic border sewing system of claim 13 further comprising a sensor mounted in front of the inserter assembly for detecting that the clamp assembly is in the preprogrammed position before inserting the label.

22. The automatic border sewing system of claim 21 wherein the sensor provides a fault indication to the control system if the sensor fails to detect a reflective tape applied to an upper edge of the clamp assembly indicating that the border is not in the preprogrammed position in front of the inserter assembly.

23. The automatic border sewing system of claim 10 further comprising an air tube provided adjacent the inserter assembly for applying a flow of air across the upper cut edges of the border to flatten the edges.

24. The automatic border sewing system of claim 10 further comprising an air tube mounted to a support in a position slightly below the clamp assembly for applying a flow of air across the lower cut edges of the border to flatten the edges.

25. An automatic border sewing system for sewing borders for mattresses and foundations with a label inserted therein, comprising:

a feed and cut assembly that receives, measures and cuts a supply of border material to form the border having a desired length;

a closer station downstream from the feed and cut assembly having a closer head for sewing cut edges of the border together to form the completed border;

a clamp assembly for engaging the border adjacent its cut ends as the border is cut by the fed and cut assembly and transferring the border from the feed and cut assembly to the closer station;

an automatic inserter assembly including a hopper having a tray with a spring-biased plate, a pair of side guide portions and a guard at a corner portion at a forward end of the tray for supplying at least one label, and a label clamp and transfer subassembly having a clamp mechanism for engaging the label and an actuator for moving the label clamp transfer subassembly forwardly into a position for inserting the label in between the cut edges of the border; and a control system for monitoring and controlling the operation of the feed and cut assembly, label inserter assembly, and closer station to form a completed border with a label sewn therein.

26. The automatic border sewing system of claim 25 wherein a stack of labels can be inserted into the tray and urged upwardly against the hold down tab by the force of a spring.

27. An automatic border sewing system for sewing borders for mattresses and foundations with a label inserted therein, comprising:

a feed and cut assembly that receives, measures and cuts a supply of border material to form the border having a desired length;

a closer station downstream from the feed and cut assembly having a closer head for sewing cut edges of the border together to form the completed border;

a clamp assembly for engaging the border adjacent its cut ends as the border is cut by the fed and cut assembly and transferring the border from the feed and cut assembly to the closer station;

an automatic inserter assembly including a hopper for supplying at least one label, a label pre-feeder adjacent a forward end of the hopper, and a label clamp and transfer subassembly having a clamp mechanism for engaging the label and an actuator for moving the label clamp transfer subassembly forwardly into a position for inserting the label in between the cut edges of the border; and a control system for monitoring and controlling the operation of the feed and cut assembly, label inserter assembly, and closer station to form a completed border with a label sewn therein.

28. The automatic border sewing system of claim 27 wherein the label pre-feeder comprises an actuator mounted on a travel cylinder, the actuator having a cylinder rod and a foot at the end of the cylinder rod wherein the foot engages an uppermost label in the hopper and the actuator is moved in a forward direction with respect to the hopper when the uppermost label is engaged.

29. The automatic border sewing system of claim 28 further comprising a label detector sensor mounted adjacent the pre-feeder actuator for detecting a label within the hopper and determining if the label has been engaged and moved into a position for insertion in the border.

30. The automatic border sewing system of claim 29 wherein the label transfer clamp subassembly comprises an inserter clamp having a pair of clamp arms that are moved in a forward direction along an upper edge of the hopper to engage and clamp the label that has been fed from the hopper by the pre-feeder and to place the label between the cut edges of the border.

31. The automatic border sewing system of claim 30 further comprising at least one label holder cylinder positioned in front of the inserter assembly and having a cylinder rod that extends when activated to engage the cut edges of the border to ensure label transfer from the inserter assembly.

32. The automatic border sewing system of claim 30 wherein the clamp subassembly further comprises a clamp detector that monitors an internal travel of a cylinder rod to determine if the actuator cylinder has been fully opened or fully closed prior to movement for insertion of the label between the cut edges of the border.

33. An automatic label inserter assembly for inserting a label between a pair of cut edges of mattress border material comprising:

a hopper for supplying a label for insertion between the cut edges of the border wherein the hopper of the label inserter assembly comprises a tray having a spring-biased plate, a pair of side guide portions and a hold down tab at a corner portion at a forward end of the tray;

a label pre-feeder mounted adjacent a forward end of the hopper; and a label clamp and transfer assembly for engaging the label and positioning the label for insertion into the border.

34. The automatic label inserter assembly of claim 33 wherein a stack of labels can be inserted into the tray and urged upwardly against the hold down tab by the force of a spring.

35. The automatic label inserter assembly of claim 33 wherein the label pre-feeder comprises an actuator mounted on a travel cylinder, the actuator having a cylinder rod and a foot at the end of the cylinder rod wherein the foot engages an uppermost label in the hopper and the actuator is moved in a forward direction with respect to the hopper when the uppermost label is engaged.

36. The automatic label inserter assembly of claim 35 further comprising a label detector sensor mounted adjacent the pre-feeder actuator for detecting a label within the hopper and determining if the label has been engaged and moved into a position for insertion in the border.

37. The automatic label inserter assembly of claim 35 wherein the label transfer clamp subassembly comprises an inserter clamp having a pair of clamp arms that are moved in a forward direction along an upper edge of the hopper to engage and clamp the label that has been fed from the hopper by the pre-feeder and to place the label between the cut edges of the border.

38. The automatic label inserter assembly of claim 37 further comprising at least one label holder cylinder positioned in front of the inserter assembly and having a cylinder rod that extends when activated to engage the cut edges of the border to ensure label transfer from the inserter assembly.

39. The automatic label inserter assembly of claim 37 wherein the clamp subassembly further comprises a clamp detector that monitors an internal travel of a cylinder rod to determine if the actuator cylinder has been fully opened or fully closed prior to movement for insertion of the label between the cut edges of the border.

* * * * *